United States Patent [19]

Petta

[11] Patent Number: 4,459,813

[45] Date of Patent: Jul. 17, 1984

[54] LEVELLING APPARATUS FOR VEHICLE MOUNTED REFRIGERATOR

[76] Inventor: John R. Petta, 820 E. 7th Ave., Escondido, Calif. 92025

[21] Appl. No.: 416,878

[22] Filed: Sep. 13, 1982

[51] Int. Cl.[3] ..... F16M 1/00; F25D 19/00

[52] U.S. Cl. ..... 62/132; 165/67; 248/661; 62/297

[58] Field of Search ..... 62/261, 262, 297, 239, 62/295, 448; 165/67, 68, 69; 254/11, 17; 280/6.11, 6.1, 763.1; 248/188.4, 661

[56] References Cited

U.S. PATENT DOCUMENTS

| | | | |
|---|---|---|---|
| 2,020,874 | 11/1935 | Budnick | 248/188.4 |
| 2,234,742 | 3/1941 | Smith . | |
| 2,247,904 | 7/1941 | Brace | 62/295 X |
| 2,672,029 | 3/1954 | Saunders . | |
| 2,682,159 | 6/1954 | Trask . | |
| 3,033,633 | 5/1962 | Holloway et al. | 312/214 |
| 3,091,946 | 6/1963 | Kesling | 62/465 |
| 3,424,413 | 1/1969 | Applegate | 248/661 |
| 3,836,162 | 9/1974 | Felkner . | |

*Primary Examiner*—William E. Wayner
*Attorney, Agent, or Firm*—Brown & Martin

[57] ABSTRACT

A vehicle mounted refrigerator includes an apparatus for levelling the condenser coils including a support frame mounted in a generally horizontal plane and pivotable about generally orthogonal axis with electrically powered levelling support jacks activated by level sensing switches for levelling the frame on which the condenser coils of the refrigerator are mounted. An alternate embodiment includes hand operated jacks for levelling the condenser coils.

10 Claims, 9 Drawing Figures

LEVELLING APPARATUS FOR VEHICLE MOUNTED REFRIGERATOR

BACKGROUND OF THE INVENTION

The present invention relates to refrigerators and pertains particularly to levelling apparatus for vehicle mounted refrigerators.

Many portable recreational vehicles have furnishings including refrigerator that makes the vehicle suitable for living quarters. Due to space considerations, the refrigerators mounted in such recreational vehicles typically have condenser coils that are mounted on top of the chassis of the refrigerator with at least portions of the coils lying in a horizontal plane. This construction and arrangement conserves floor space but creates a necessity for levelling the refrigerator each time the vehicle is parked or set up for overnight use. The refrigerator in such vehicles is typically anchored either to a wall of the vehicle housing or the floor of the vehicle so that it will not move about during travel. The refrigerator is typically anchored after levelling with the vehicle previously levelled.

Since the refrigerator is anchored to the walls of the vehicle it is necessary to level the vehicle in order to level the refrigerator. Without the refrigerator levelled, the refrigerant within the condenser coils will not properly flow within the circuit. Many campgrounds and parking space for such vehicles are not level. This requires that the vehicle be levelled either by special jacks or by driving the vehicle on to blocks that must be carried in the vehicle. Both of these approaches are not only time-consuming but are unpleasant during severe weather conditions.

It is therefore desirable that improved means be available for easily and conveniently levelling the cooling coils of a recreational vehicle refrigerator.

SUMMARY AND OBJECTS OF THE INVENTION

In accordance with the primary aspect of the present invention, the condenser coils of the refrigerator are mounted on a frame that is pivotable about a pair of generally mutually perpendicular horizontal axis by means of jacks for selectively levelling the condenser coils.

Another aspect of the invention includes level responsive electrical circuit means for activating powered jacks for automatically levelling the condenser coils upon activating the electrical circuit.

It is a primary object of the present invention to provide improved means for levelling the condenser coils of a refrigerator.

BRIEF DESCRIPTION OF THE DRAWINGS

The above and other objects and advantages of the present invention will become apparent from the following description when read in conjunction with the drawings wherein.

DETAILED DESCRIPTION OF THE PREFERRED EMBODIMENTS

Figure 1:
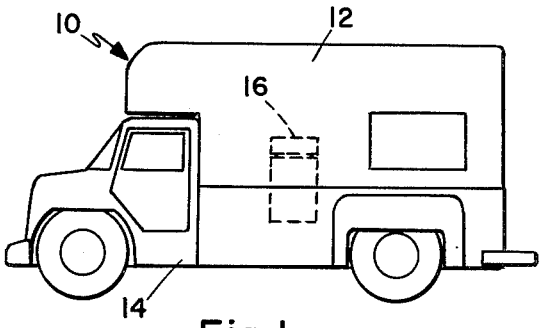
FIG. 1 illustrates a typical recreational vehicle with the refrigerator position indicated.

Turning to FIG. 1 of the drawing, a motorized recreational vehicle is illustrated and designated generally by the numeral 10 and includes a box-like living compartment 12 mounted on a truck chassis 14. A typical position for a refrigerator within the living compartment of the vehicle is shown at 16 and in which a refrigerator 18 is mounted. It is obvious that should the vehicle positioned to head uphill or downhill, the refrigerator will be tilted to the one side or the other. If, on the other hand, the vehicle is sitting in a position such that one side is lower than the other, then the refrigerator will be tilted either forward or backward such that the refrigerant fluid within the condenser coil may not flow freely within the system and the refrigerator will thereby fail to function properly.

Figure 2:
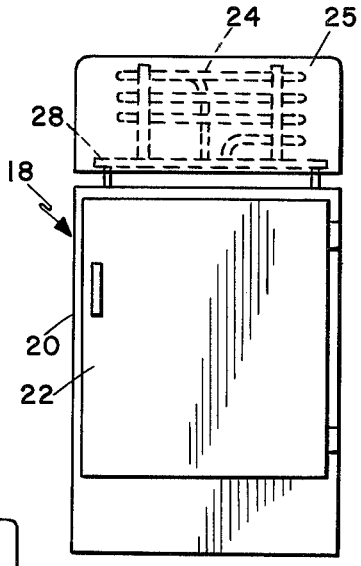
FIG. 2 is a front elevation view of the refrigerator and top coil assembly.

Turning to FIG. 2, a typical refrigerator is shown designated generally by the numeral 18 comprising a chassis or cabinet 20 having a door 22 to provide access to the interior thereof. The refrigerator unit includes condenser coils 24 which are in this figure shown covered by a cover 25.

Figure 3:
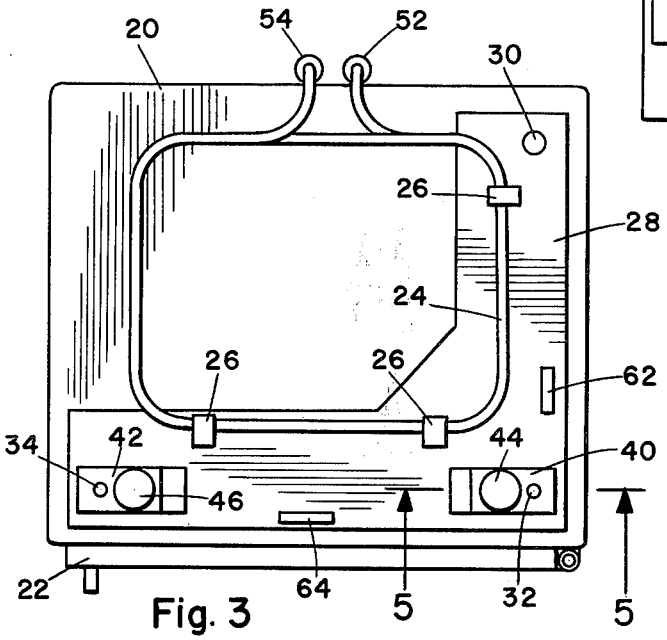
FIG. 3 is an enlarged top plan view of the coil assembly with the cover removed.
Figure 4:
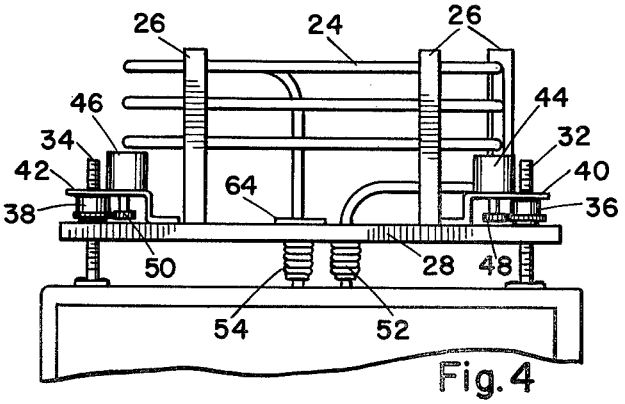
FIG. 4 is a front elevation view of the structure of FIG. 3.
Figure 5:
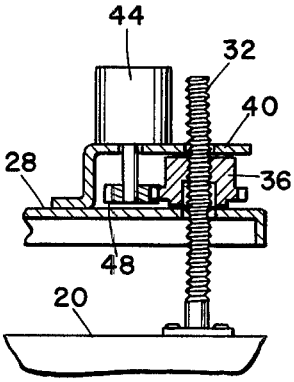
FIG. 5 is a sectional view taken on line 5—5 of FIG. 3.
Figure 6:
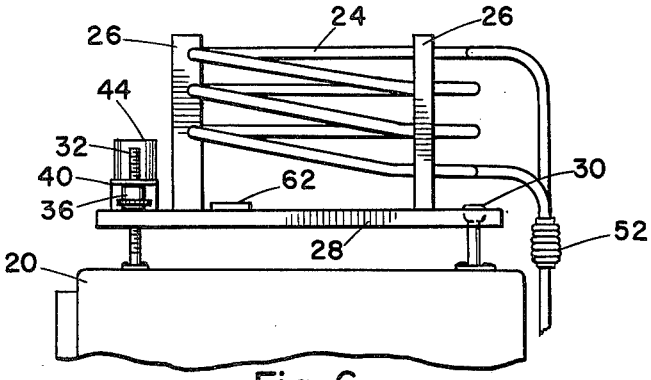
FIG. 6 is a side elevation view of the right hand side of FIG. 4.

Turning to FIG. 3, the coils are shown mounted by support members 26 on a support plate or platform 28. The support platform has a generally L-shaped configuration and includes a stationary pivoting support 30 at one corner and a pair of movable or adjustable support members 32 and 34 at the other two corners. These adjustable support members 32 and 34 are illustrated as being a pair of screws of a screw-type jack having rotatable nuts 36 and 38 secured to, but rotatably mounted on the platform 28 by means of brackets 40 and 42. Electrical motors 44 and 46 are connected by pinion gears 48 and 50, respectively, to the screws 36 and 38 for rotation of the screws and thereby moving them along the axis of the stationary screw members 32 and 34. The screw members 32 and 34 are fixed at their bases to the chasis 20 of the refrigerator unit.

Figure 7:
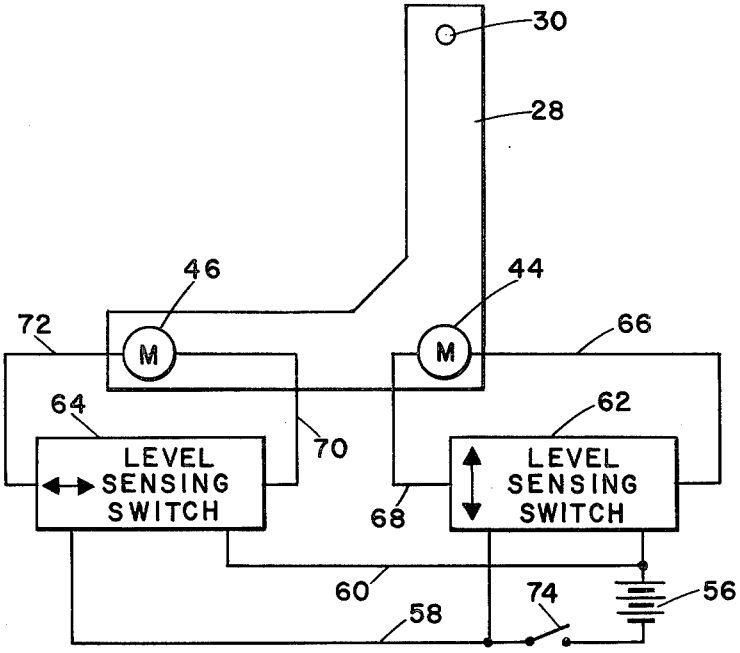
FIG. 7 illustrates the electrical levelling system.

These jacks can function to raise either of the corners at screws 32 and 34 or lower these corners relative to one another and the pivot support 32. This can function to similarly raise or tilt the coil 24 such that it is adjustable independently of the refrigerator chassis 20. The coil 24 is connected into the refrigeration system or circuit by means of flexible couplings 52 and 54 which permit the coil to be moved relative to the chassis or housing of the refrigerator without breaking or otherwise damaging the coil. The flexible coupling can be any suitable form such as the Bellows type, Neoprene or other similar couplings. In addition, the coils or pipes themselves can be coiled one or two times about a pivot axis which will permit it to pivot to a certain degree without undue stress and/or damage thereto. The powered jacks in the illustrated embodiment are powered by a self-levelling circuit which is illustrated in FIG. 7. This circuit has incorporated therein orthogonally oriented level sensor switches such that when the coils are levelled, the switches break the circuit. When the coils are not level in either of the two planes, the levelling switch for that plane will be activated, thereby activating the respective motor for either raising or lowering the coil support plate or platform 28.

The circuit as illustrated in FIG. 7 includes a source of power such as a battery 56 which is connected into a circuit including conductors 58 and 60 which connect to the levelling switches 62 and 64, which in turn are connected by conductors 66 and 68, 70 and 72 to the respective jack motors 44 and 46. A manual switch 74 which is preferably of the type that is biased to the off position may be utilized to activate the basic circuit.

In operation, when a recreational vehicle having a refrigerator equipped as herein described, goes into a parking place for set-up overnight or the like, the driver need only level his vehicle to the extent necessary for comfort. He then activates the refrigerator and levelling switch 74 such as by pressing a button or the like and the circuit, if a non-level condition is sensed, activates and supplies power to the respective one of the reversible electric motors 44 and 46. The motors then operate to drive the respective jacks for moving the coil support platform to the necessary position for levelling the unit.

Figure 8:
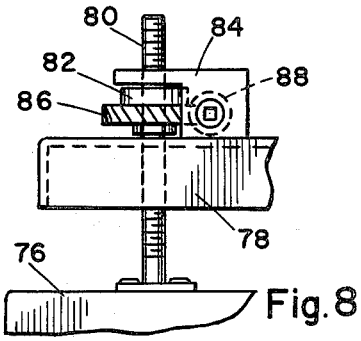
FIG. 8 is a front elevation view of an alternative manually operated levelling jack.
Figure 9:
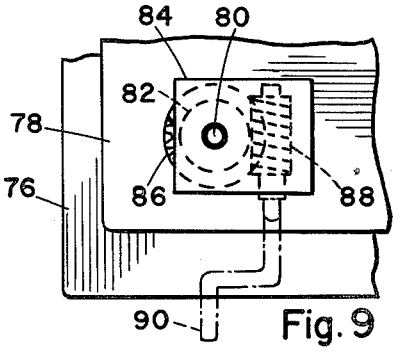
FIG. 9 is a top plan view of the structure of FIG. 8.

Turning to FIGS. 8 and 9, mechanical jacks are shown which may be utilized in place of the aforementioned electrical jacks. With the mechanical jacks, a level indicator of some type may be necessary in order to establish the level condition of the coils. Refrigerator chassis 76 is illustrated with a coil support plate or platform 78 supported as illustrated in the previous embodiment with a jack screw 80 extending upward from the upper surface of the refrigerator chassis 74. A jack screw nut 82 is mounted in a bracket 84 on the platform 78 and engages the screw 80. A worm gear 86 integral with nut 82 is engaged by a worm 88 rotatably mounted within the bracket 84 and may be rotated by means of a detachable crank 90. This provides an inexpensive alternative that may be embodied in the system. A similar jack screw arrangement would be used at each front corner of platform 78.

Thus, while I have illustrated and described my invention by means of specific embodiments, it is to be understood that numerous changes may be made therein without departing from the spirit and scope of the invention as defined in the appended claims.

I claim:

1. In a refrigerator including a chassis and a refrigerator unit having a separately moveable condensing coil, a levelling apparatus for levelling solely the separately moveable condenser coil relative to the chassis and refrigerator unit comprising:

a support frame mounted in a generally horizontal plane on said chassis;

a movable condenser coil separately and exclusively mounted on said support frame and separately and exclusively moveable with said frame relative to said chassis and refrigerator unit;

a pivot support unit for supporting said frame on said chassis for pivotal movement relative to said chassis about substantially orthogonal axis;

a first elevating support unit spaced from said pivot support unit for pivoting said support frame about a first axis; and, a second elevating support unit spaced from said pivot support unit for pivoting said support frame about a second axis substantially orthogonal to said first axis.

2. The levelling apparatus of claim 1 wherein said condenser coil includes flexible coupling means for enabling movement of said coil relative to said chassis.

3. The levelling apparatus of claim 2 wherein said support units are positioned in a triangular array.

4. The levelling apparatus of claim 3 wherein said elevating support units are screw jacks including an elongated rotating screw for selectively elevating said support frame.

5. The levelling apparatus of claim 4 wherein said jacks are operated by electrical means including an electric motor and a levelling electric circuit including switch means responsive to a level condition of said support frame.

6. The levelling apparatus of claim 4 wherein said jacks are mechanically driven.

7. The levelling apparatus of claim 4 wherein said flex coupling means is a coil of multiple turns formed in the refrigerant line between the condenser coil and the chassis.

8. In the combination of a mobile vehicle and a refrigerator mounted therein, a refrigerator including a chassis and a refrigerator unit having a separately moveable condensing coil, a levelling apparatus for levelling solely the separately moveable condenser coil relative to the chassis and refrigerator unit, comprising:

a support frame mounted in a generally horizontal plane on said chassis;

a moveable condenser coil, said condenser coil including flexible coupling means for enabling movement of said coil relative to said chassis, separately and exclusively mounted on said support frame and separately and exclusively moveable with said frame relative to said chassis and refrigerator unit;

a pivot support unit for supporting said frame on said chassis for pivotal movement relative to said chassis about substantially orthogonal axis;

a first elevating support unit comprising a screw jack including an elongated rotating screw for selectively elevating said support frame spaced from said pivot support unit for pivoting said support frame about a first axis;

and, a second elevating support unit comprising a screw jack including an elongated rotating screw for selectively elevating said support frame spaced from said pivot support unit for pivoting said support frame about a second axis substantially orthogonal to said first axis wherein said support units are positioned in a triangular array.

9. The levelling apparatus of claim 8 wherein said jacks are operated by electrical means including an electric motor and a levelling electric circuit including switch means responsive to a level condition of said support frame.

10. The levelling apparatus of claim 8 wherein said jacks are mechanically driven.

* * * * *